US005493970A

United States Patent [19]

Stoffler et al.

[11] Patent Number: 5,493,970

[45] Date of Patent: Feb. 27, 1996

[54] METHOD AND APPARATUS FOR REGULATING INK DISTRIBUTION IN AN UNDERSHOT INKING UNIT OF A PRINTING MACHINE

[75] Inventors: Achim Stoffler, Offenbach; Valentin Gensheimer, Muhlheim; Edgar Werber, Offenbach; Marc Hinz, Rodenbach; Peter Hummel, Offenbach; Jurgen Wenzel, Hainburg Hess; Albrecht Volz, Rodermark; Joachim Blumor, Hainburg Hess; Hubert Zschetzsche; Manfred Straub, both of Offenbach, all of Germany

[73] Assignee: MAN Roland Druckmaschinen AG, Germany

[21] Appl. No.: 237,076

[22] Filed: May 3, 1994

[30] Foreign Application Priority Data

May 3, 1993 [DE] Germany ..... 43 14 426.9
Mar. 30, 1994 [DE] Germany ..... 44 11 109.6

[51] Int. Cl.[6] ..... B41F 31/06; B41F 31/14

[52] U.S. Cl. ..... 101/363; 101/DIG. 32; 101/483

[58] Field of Search ..... 101/DIG. 32, 349, 101/350, 351, 352, 148, 207–210, 340, 344, 347, 355, 356, 360, 361, 363, 484, 485

[56] References Cited

U.S. PATENT DOCUMENTS 3,746,957 7/1973 Forster et al. ..... 318/696
4,007,683 2/1977 Dickerson .

FOREIGN PATENT DOCUMENTS

264838B1 4/1988 European Pat. Off. .
518234A1 12/1992 European Pat. Off. .
2193926 2/1988 United Kingdom ..... 101/DIG. 32

*Primary Examiner*—J. Reed Fisher
*Attorney, Agent, or Firm*—Leydig, Voit & Mayer, Ltd.

[57] ABSTRACT

An undershot inking unit and associated method are disclosed. The undershot inking unit includes an ink fountain roller that is controlled independently of the printing speed of the printing machine, and in which the rotational contact angle of the distributor roller on the ink fountain roller is varied according to the printing unit speed. The method comprises controlling the rotational speed of the ink fountain roller independently of the printing speed of the printing machine; and varying the rotational contact angle of the intermittent ductor roller on the ink fountain roller according to the printing speed of the printing machine. In a preferred embodiment, the apparatus includes two coaxial cams rotatably adjustable with respect to each other. Each cam includes a predominant circumferential contour and a subordinate circumferential contour. By adjusting the relative rotational position of the cams, the rotational contact angle of the ductor roller on the ink foundation roller is varied according to the printing unit speed.

6 Claims, 5 Drawing Sheets

METHOD AND APPARATUS FOR REGULATING INK DISTRIBUTION IN AN UNDERSHOT INKING UNIT OF A PRINTING MACHINE

FIELD OF THE INVENTION

The present invention relates generally to a method and apparatus for regulating the distribution of ink in a printing machine. More specifically, the present invention is directed towards an undershot inking unit and an associated method for regulating the ink distribution in a variable speed printing machine.

BACKGROUND OF THE INVENTION

In sheet-fed offset printing machines, the supply of printing ink is generally accomplished by means of an undershot inking unit. Undershot inking units comprise an ink fountain and associated metering devices, such as ink-metering elements or undivided ink doctor blades; an ink fountain roller; an intermittent ductor roller, and one or more inking rollers. By means of the metering elements, the ink layer thickness on the ink fountain roller is adjusted in accordance with the requirements of the printing machine. The intermittent ductor roller, as a result of periodic contact with the ink fountain roller, removes a strip of ink of a certain length from the ink fountain roller and transfers the ink onto the first inking roller. This first inking roller is usually designed as an axially reciprocating distributor roller for contacting further inking rollers through traversing movements of adjustable stroke and/or frequency. By means of these further inking rollers, the ink quantity fed by the ductor roller splits and correspondingly leads to an inking of the printing regions on the printing form or plate located on the plate cylinder.

Typically, the intermittent ductor roller is rotatably journalled in a pair of pivotable bearing levers. Each of the pivotable bearing levers is coupled with a cam follower roller drive, by which an intermittent or pendulating movement of the ductor roller between the ink fountain roller and the distributor roller is achieved. The cam disk of the intermittent ductor roller drive usually is driven directly from the printing mechanism, with a corresponding reduction in rotational speed (such as a 3:1 reduction). Thus, a ductor stroke, or pendulating movement of the ductor roller between the ink fountain roller and the inking roller, occurs with respect to a corresponding number of revolutions of the plate cylinder (such as 3).

The ink fountain roller can have a mechanical drive derived from the printing mechanism, or it may have a controllable electrical drive. In conventional undershot inking units, the rotational speed of the ink fountain roller is dependent upon the printing speed of the printing machine, and may vary continuously or incrementally with the printing speed. Such conventional ink fountain rollers are described in U.S. Pat. No. 4,007,683 and in EP 518,234 A1 and EP 264,838 B1.

The amount of ink fed to the inking roller in such conventional devices is controlled by regulating the rotational contact angle, or contact time, of the ductor roller on the ink fountain roller so as to regulate the ductor-strip width. Regulation of the ductor-strip width is accomplished either by adjusting the design of the cam disk for the ductor roller drive by means of adjustable control planes, or by modulating the speed of the ink fountain roller. Where the ductor-strip width is regulated by modulation of the ink fountain roller, the rotational speed of the ink fountain roller is determined by the speed of the printing machine and by independent adjustment. Thus, the characteristic curve by which the rotational speed of the ink fountain roller is coupled with the printing machine speed is varied. Where the ductor-strip width is adjusted by means of a variable cam disk, the coupling of the rotational speed of the ink fountain roller with the speed of the printing machine is obtained by an invariable characteristic curve. EP 264,838 B1 discloses the regulation of the ductor-strip width by regulating the ink fountain roller speed by means of a switching drive, which controls the step width of the ink fountain roller. The drive of the ductor roller and the corresponding switching drive for the ink fountain roller operate in phase in such manner that the rotation of the ink fountain roller occurs in the phase of contact with the ductor roller.

The distribution of ink is typically determined during setup of the printing machine. This generally occurs at a relatively low printing speed, such as 5,000 sheets per hour with a conventional offset printing machine. During actual production, however, the production speeds of such machines can be greater than 15,000 sheets per hour. When the undershot inking unit has been calibrated at a lower printing speed, it is invariably observed that the ink densities detected on a print check strip and in the image decrease as a whole. The ink density changes from low to high production speed are typically quite significant in the prior art machines. This effect is know as ink fall-off.

Conventional inking mechanisms have thus far been unable to resolve the problem of ink fall-off. The present invention seeks to provide an apparatus and associated method for overcoming the problems associated with conventional inking mechanisms in this regard.

BRIEF SUMMARY OF THE INVENTION

The present invention provides an undershot inking unit in which the rotational contact angle, or contact time, of the distributor roller on the ink fountain roller is varied according to the printing unit speed. The speed of the ink fountain roller is controlled independently of the printing speed, and may be maintained at a constant speed or driven stepwise at a constant stepping frequency and rotational speed for all printing unit speeds. In contrast to conventional inking mechanisms, the ductor-strip width remains constant for all printing speeds, and the feed of ink is regulated by allowing the ductor to be thrown more or less frequently onto the ink fountain roller at an adjustable rotational contact angle. This is accomplished by a pair of coaxial cams that are rotatably adjustable with respect to each other. Each cam has a predominant circumferential contour and a subordinate circumferential contour. By adjusting the relative rotational position of the cams, the rotational contact angle of the ductor roller on the ink foundation roller is varied according to the printing unit speed. The present invention thus alleviates the problem of ink fall-off in a manner heretofore unknown to the art.

DESCRIPTION OF THE PREFERRED EMBODIMENTS

Figure 1:
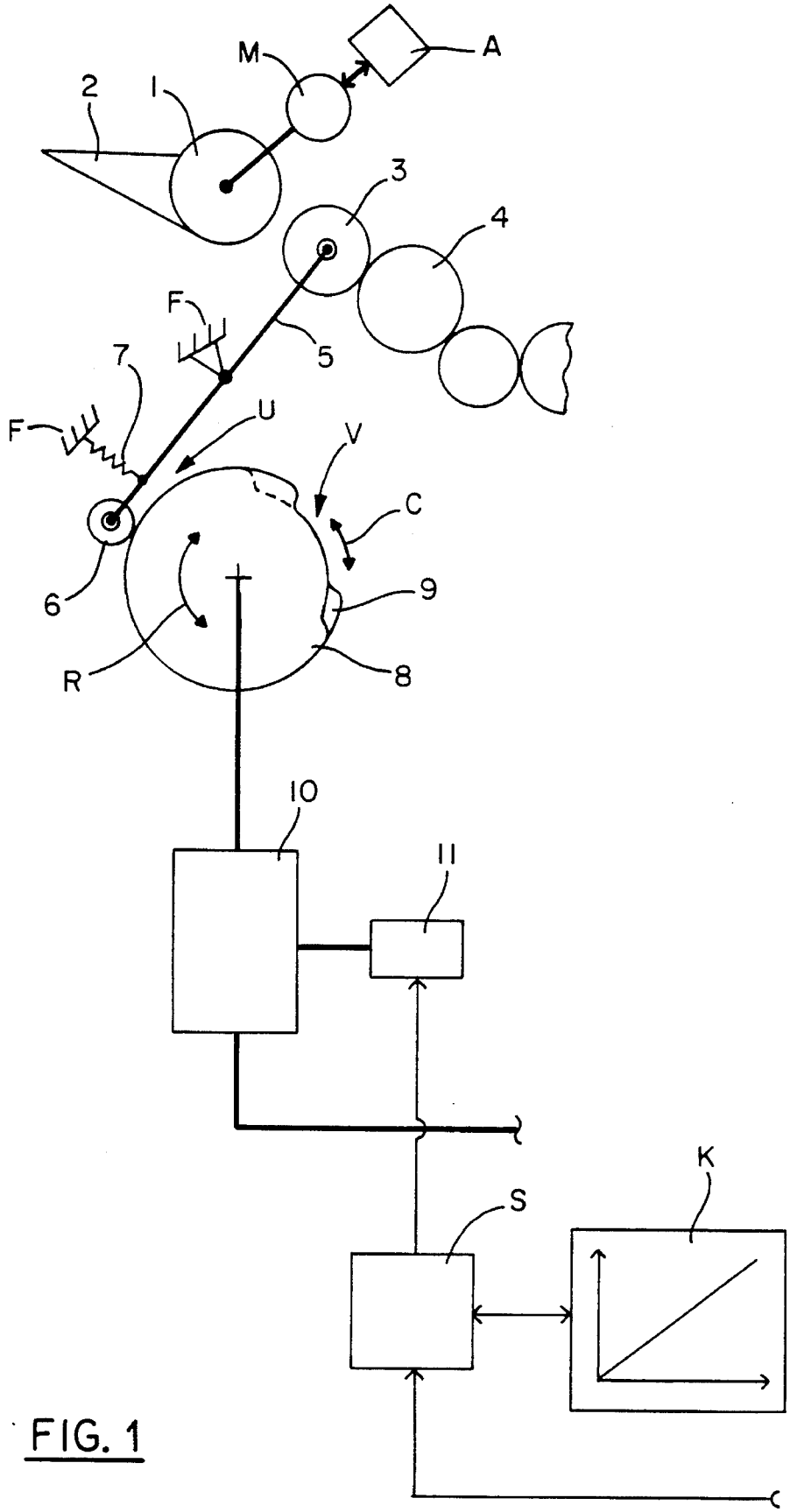
FIG. 1 is a schematic representation of an undershot inking unit for a printing machine according to the present invention.

According to the invention, the rotational contact angle of the ductor roller for removing an amount of ink from the ink fountain roller is chosen as a function of the printing speed. The dependence of the rotational contact angle on the printing speed may be represented linearly. Alternately, the dependence of the contact angle on the printing speed can be nonlinear in whole or in part. The characteristic curve can be determined empirically or theoretically.

The present invention further utilizes the knowledge that inks used in offset printing technology have pronounced non-Newtonian properties. Because the ink fountain roller is driven at a speed independent from the printing speed, the inks possess the same properties regardless of the printing speed.

Preferably, the speed of the ink fountain roller is maintained independently from the printing speed. However, the present invention also contemplates an inking unit in which the rotational speed of the ink fountain roller can be adjusted by the operator to a higher or lower speed, thus increasing or decreasing the ductor strip width.

In a preferred embodiment of the present invention, the change of the rotational contact angle of the ductor roller on the ink fountain roller is initiated by a certain number of machine revolutions (angle degrees) before the change of the printing speed. For example, if the operator desires to increase the printing speed from 5,000 to 15,000 sheets per hour, then the contact angle is first adjusted to the proper value provided for at 15,000 sheets per hour. After a certain number of machine revolutions, the speed of the printing machine is then increased to 15,000 sheets per hour. A similar procedure takes place when the operator desires to decrease the speed of the printing machine.

The number of revolutions by which the initiation of the speed change is offset by the change of the contact angle is ascertained by a number of factors, for example, the ductor rhythm, the geometry of the inking mechanism, and the geometry of the printing unit. This number is determined by counting the number of revolutions of the printing mechanism must occur until a layer thickness change of ink on the first distributor roller brings about a corresponding layer thickness change on one of the ink applicator rollers. As a reference, the ink applicator roller can be chosen which causes the perceptually greatest ink application to the printing plate or the ink applicator roller which conditions the shortest and thus also the least number of machine degrees that bring about an inking change from the distributor roller to the ink applicator roller. The number of revolutions that the printing machine must go through until an inking change initiated on the printing plate results in a change on the printing sheet or printing zone also must be taken into account. Preferably, the change of the contact angle following an input command to change the printing speed is initiated at the same angular position of the ductor gear, for example, when the ductor roller bears on the distributor roller.

Any suitable drive for altering the rotational contact angle of the ductor roller on the ink fountain roller may be used in accordance with the present invention. In a preferred embodiment, the ductor roller is driven by means of a pair of adjustable cam disks driven by the printing mechanism. The drive comprises two adjacent cam disks with common axes of rotation, which are driven in common from the printing or inking mechanism. On the outer contours of these cam disks runs a cam follower roller, biased under spring force, which is coupled to a lever arm of the ductor roller. The camming of the cam follower roller running along the combined contour of the pair of cams generates the intermittent pendulating movement of the ductor roller.

Figure 2:
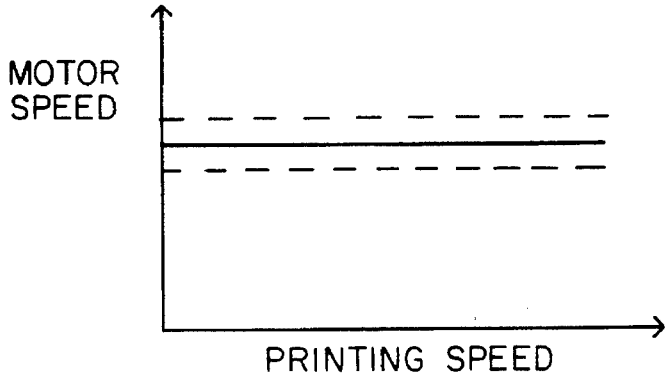
FIG. 2 is a characteristic curve for the drive of the ink fountain roller as a function of the printing speed.

With reference to FIG. 1, an ink fountain roller 1 cooperates with an ink fountain 2 and conventional ink metering elements (not shown) mounted on the underside of an ink fountain 2. Preferably, the ink fountain roller 1 is directly coupled with a motor M with the interposition of a suitable reduction gear (not shown). The motor M is controlled by an electronic drive shown schematically at A. FIG. 2 illustrates one graphic representation of the motor speed (ordinate) as a function of the printing speed (abscissa). Because the ink fountain roller 1 has a constant value or stepping frequency independent of the printing speed, the electronic drive A is not coupled to the control of the remaining printing machine except for purposes of increasing or decreasing the rotational speed setting. Increased and decreased speeds are illustrated in FIG. 2 as broken lines, and yield larger or smaller ductor strip widths, respectively.

With further reference to FIG. 1, the ink fountain roller 1 is followed in the direction of ink transport by a ductor roller 3 which is journalled at each end on pivotable bearing arms 5, which are carried in a side frame F of the printing machine or inking unit. Attached to the second end of bearing arm 5 is mounted a cam follower roller 6 which is biased under the force of a spring 7 onto the outer contours of two adjacently mounted cam disks 8, 9.

In the illustrated embodiment, the ductor roller 3 is followed by an inking roller or first distributor roller 4, which is in contact with further inking rollers generally depicted in FIG. 1. By means of the ductor roller cam drive, the ductor roller 3 oscillates with an intermittent movement between the ink fountain roller 1 and the distributor roller 4. The distributor roller 4 may be a non-traversing inking roller, or, via an adjustable axial traversing drive, as a distributor roller adjustable in the amount of the axial traversing stroke.

Figure 4:
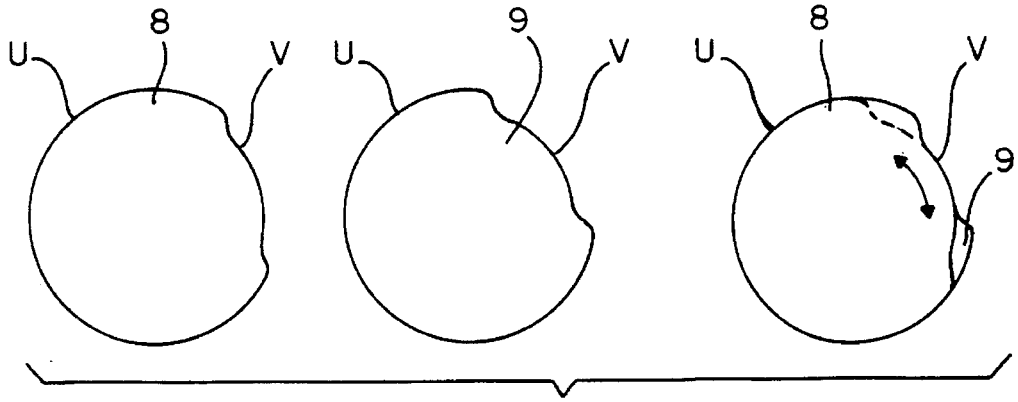
FIG. 4 is schematic illustration of the cam discs for the ductor roller drive according to the present invention.
Figure 5:
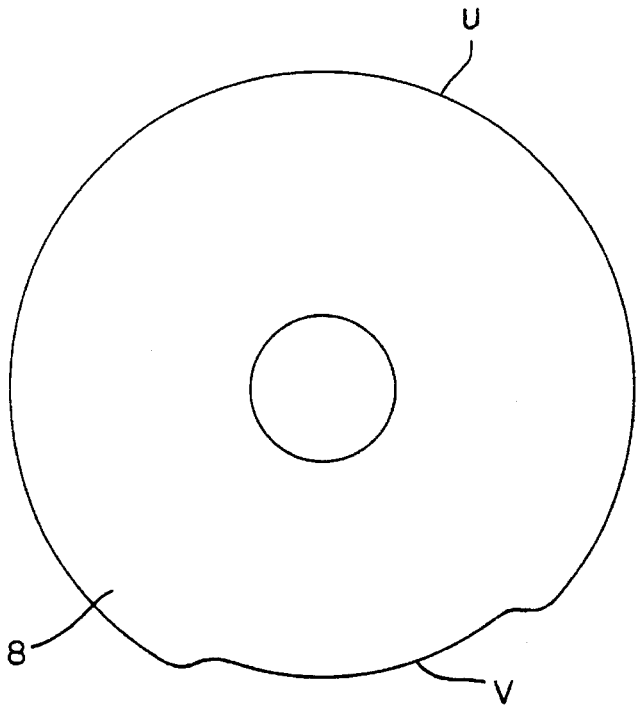
FIG. 5 is a side profile view of a first cam of the ductor roller drive in an undershot inking unit according to the present invention.
Figure 6:
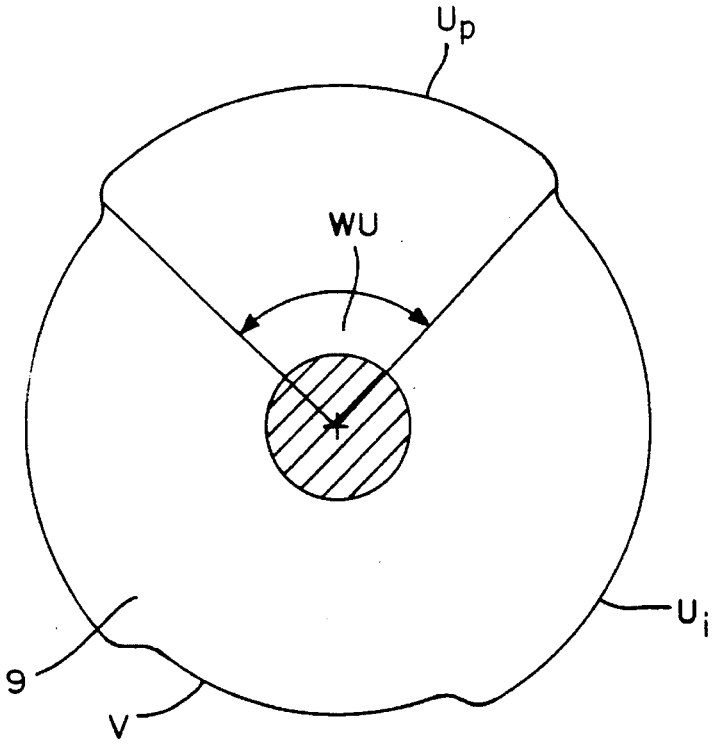
FIG. 6 is a side profile view of a second cam of the ductor roller drive in an undershot inking unit according to the present invention.
Figure 7:
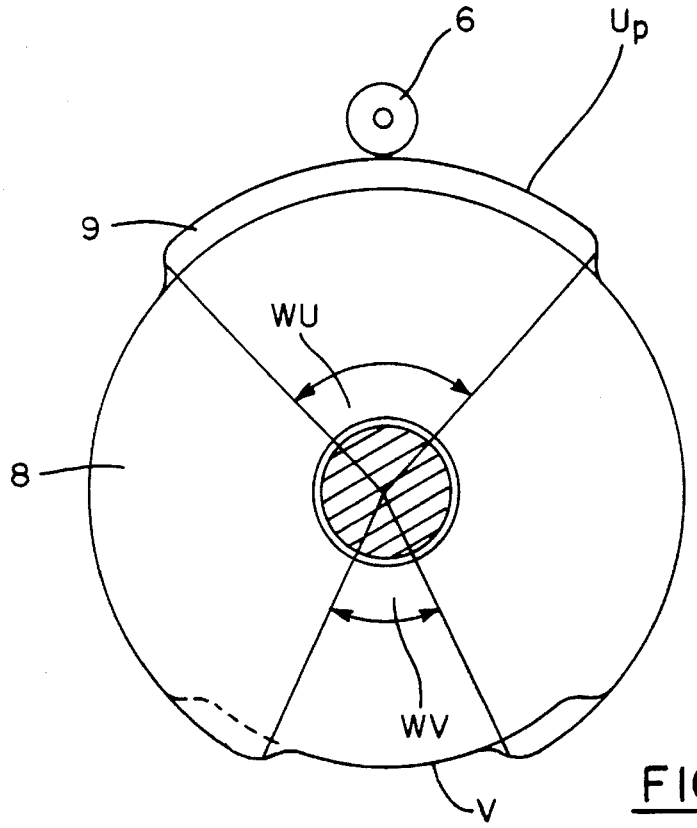
FIG. 7 is a side elevation view of the coaxially mounted first and second cams in the ductor roller drive of the undershot inking unit according to the present invention.
Figure 8:
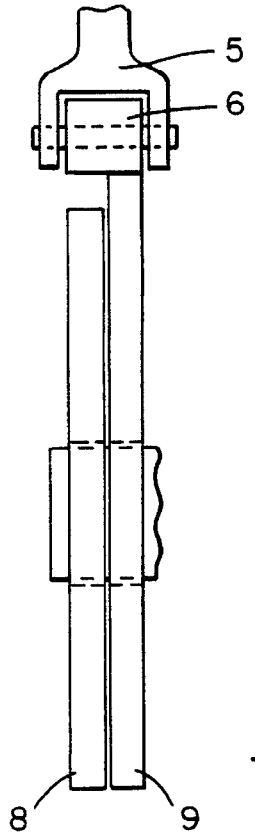
FIG. 8 is a front elevation view of the ductor roller drive illustrated in FIG. 7.

With reference to FIGS. 1 and 4, the two cams 8, 9 are driven with the interposition of an adjusting gear 10 by the printing unit or by the inking unit, there being provided also a suitable reducing gear (not shown). FIG. 1 is a schematic representation only, and the cam disks may actually be constructed such that cam disk 8, the main cam, is driven directly by the printing or inking unit and the cam disk 9, the adjusting cam, is arranged rotatably with respect to cam disk 8 and parallel thereto.

As illustrated schematically in FIG. 4, both cam disks 8 and 9 have a predominant circumferential contour U and a subordinate circumferential contour V connected via two S-form transitions. The predominate circumferential contour U has a large radius of curvature relative to the subordinate circumferential contour V, which has a small radius of curvature. By superimposing the cam disks 8 and 9 according to FIGS. 1 and 4, an adjustable control cam results. The cam follower roller 6 runs on the circumferential contour U of the cam disk 8 and/or cam disk 9 and in the remaining region depending on the relative position of the cam disks.

In the schematic representation of FIG. 1, the common subordinate circumferential contour V of the cam disks 8, 9 is effective to the throw of the ductor roller 3 onto the ink fountain roller 1. The adjustability of the cam disks 8, 9 relative to one another with simultaneous drive of the printing unit or inking unit over the adjusting gear 10 is designated in each case with an arrow C. The direction of rotation of the control cam is also represented with an arrow R in FIG. 1.

A preferred structure for cam disks 8 and 9 is illustrated in FIGS. 5–8. Cam disk 9 preferably has in angular range WU a predominant circumferential contour $U_p$, an intermediate circumferential contour $U_i$, and a subordinate circumferential contour V. The predominant circumferential contour $U_p$ is arranged to control the contact angle of the ductor roller 3 on the distributor roller 4. In other words, the cam disk 8 preferably has two radii and the cam disk 9 has three radii. When the cam follower roller 6 runs on the middle radius of the control cam formed by cams 8, 9, then the ductor roller 3 is located in an intermediate position between but out of engagement with the ink fountain roller 1 and the distributor roller 3.

Because only cam disk 9 has a predominate circumferential contour $U_p$ which controls the contact of ductor roller 3 with the distributor roller 4, the control cam formed by cams 8, 9 ensures that the contact angle of the ductor roller 3 on the distributor roller 4 becomes independent of the turning of cam disks 8, 9. The ductor roller 3 thus always executes the same number of revolutions, or fractions thereof, in contact with the distributor roller 4, regardless of the relative positions of cam disks 8, 9. Designated as WU or WV in FIGS. 5–8 are the contact angles with respect to a revolution of the cam disks 8, 9 of the ductor roller 3 on the distributor roller 4 or on ink fountain roller 1 respectively. As is evident from FIG. 7, the contact angle WV of the ductor roller 3 on the ink fountain roller 4 is variable, but the contact angle WU of the ductor roller 3 on the distributor roller 4 remains constant regardless of the relative rotational position of cams 8, 9.

In a preferred embodiment, adjusting gear 10 is actuated by a servomotor 11, as illustrated in FIG. 1. The servomotor 11 receives its setting signals from a control S, and further receives setting signals over an indicated signal line an information datum on the printing speed, for example, in the form of a tacho-signal or of a printing speed proportional impulse sequence. Coupled to the control S is a characteristic-curve storage unit K, in which are stored the turning of the cam disks 8, 9 to be brought about by the servomotor 11 over the adjusting gear 10 relatively to one another as the ordinate values as a function of the printing speed as the abscissa value.

Figure 3:
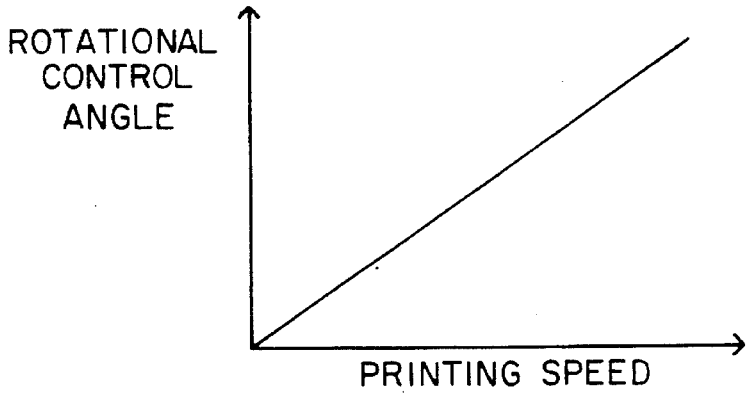
FIG. 3 is a characteristic curve of the rotational contact angle of the ductor roller on the ink fountain roller as a function of the printing speed.

FIG. 3 is a characteristic curve of the rotational contact angle of the ductor roller 3 on the ink fountain roller 1 as a function of the printing speed. Because the rotational contact angle of the ductor roller 3 on the ink fountain roller 1 corresponds to the relative position of cams 8 and 9, FIG. 3 may also represent the relative rotational position of cams 8 and 9 if the ordinate is correspondingly scaled.

Figure 9:
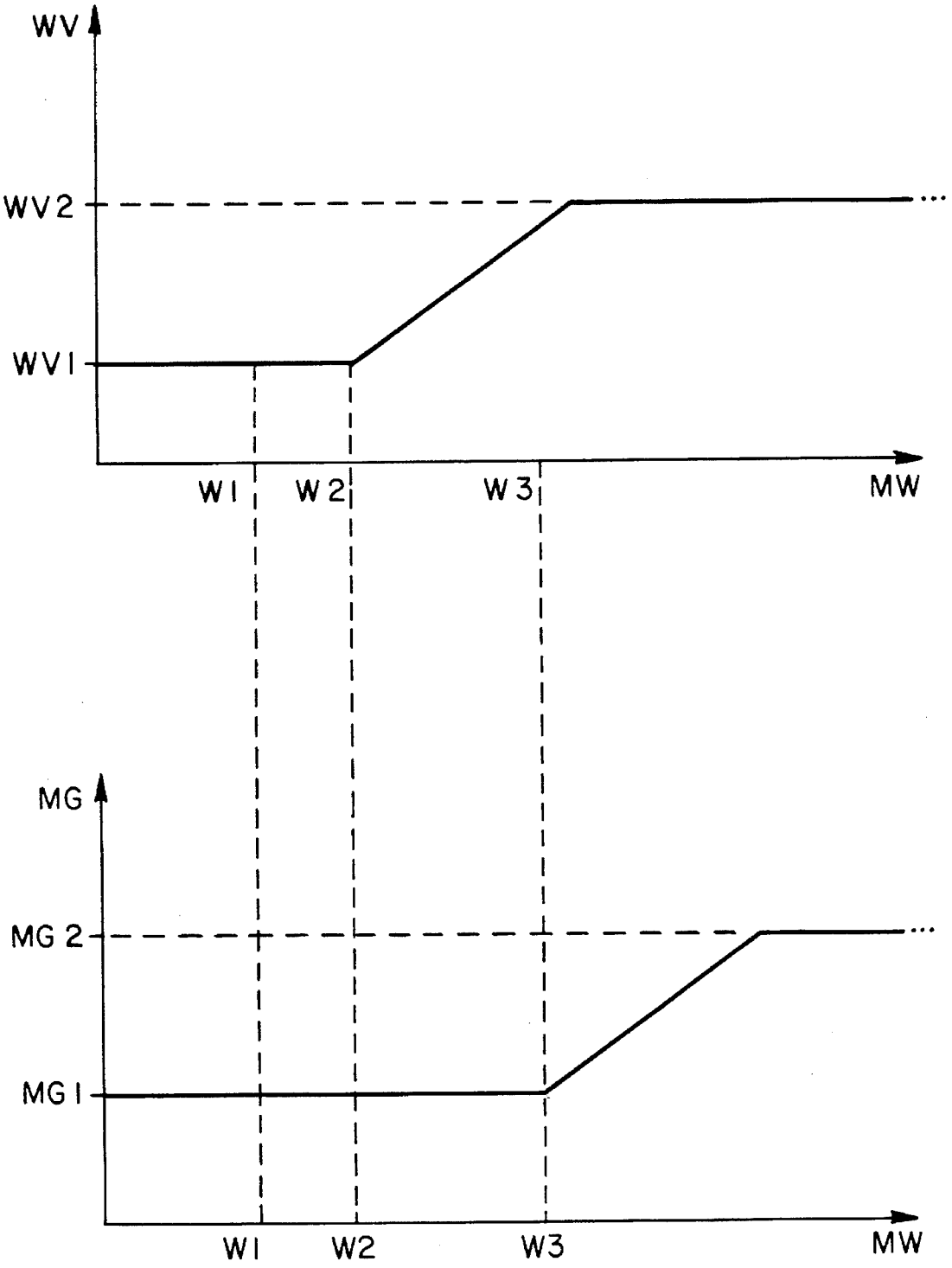
FIG. 9 is a graphical representation of the change in rotational contact angle as it corresponds to the change in printing machine speed.

FIG. 9 shows two diagrams of the course of the contact angle WV of the ductor roller 3 on the ink fountain roller 1 as a function of the machine angle MW as well as the machine speed MG as a function of the machine angle MW. At point W1 a command is input for the increasing of the machine speed from MG1 to MG2. At point W2 of the machine angle, a driving-up of the bearing angle WV occurs from WV1 to WV2. This occurs, for example, when the ductor roller 3 contacts the distributor roller 4. Only at point W3 of the machine angle MW does the initiation of the raising of the machine speed MG from the staring value MG1 to the intended value MG2 occur. Thus, with respect to the machine angle MW, the driving-up of the machine speed MG and altogether the contact angle value W3–W1 occurs with a prearranged amount of delay.

A complementary procedure occurs when the machine speed is reduced from a higher value to a lower value. The contact angle of the ductor roller in this case slopes downward between points W2 and W3, and the machine speed slopes downward after point W3.

While particular embodiments of the invention have been shown and described, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references cited are herein incorporated by reference in their entireties.

What is claimed is:

1. An undershot inking unit for a printing machine, said undershot inking unit comprising:

an ink fountain for supplying printing ink;

an ink fountain roller communicating with said ink fountain;

drive means for driving said ink fountain roller, whereby an ink film is generated on the surface of said ink fountain roller, wherein said ink fountain roller drive means are controllable independently of the printing speed of said printing machine;

an intermittent ductor roller for periodically contacting said ink fountain roller and an inking roller to transfer said ink film from said ink fountain roller to said inking roller; and intermittent ductor roller drive means for varying the rotational contact angle of said inking roller on said ink fountain roller according to the printing speed of the printing machine, wherein said intermittent ductor roller drive means comprises:

a first cam, said first cam having a first predominant circumferential contour and a first subordinate circumferential contour;

a second cam, said second cam having a second predominant circumferential contour and a second subordinate circumferential contour, said second cam being coaxial with said first cam to thereby form a control cam having a cumulative predominant circumferential contour and a cumulative subordinate circumferential contour;

a cam follower drive roller connected to a pivotal lever arm journalling said intermittent ductor roller for traversing said control cam to thereby cause said intermittent ductor roller to periodically contact said ink fountain roller and said inking roller; and cam orientation means for adjusting the rotational orientation of said first cam with respect to said second cam.

2. An undershot inking unit according to claim 1, wherein said cam orientation means comprises an adjusting gear and a servomotor operably connected to said adjusting gear.

3. An undershot inking unit according to claim 1, wherein said first cam has a first predominant circumferential contour, and an intermediate circumferential contour, said intermediate circumferential contour coinciding with said predominant second circumferential contour of said second cam, and said first cam has a first subordinate circumferential contour coinciding with said second subordinate circumferential contour of said second cam.

4. A method for regulating the distribution of ink in an undershot inking unit for a printing machine, said undershot inking unit comprising an ink fountain; an ink fountain roller cooperating with said ink fountain, whereby an ink film is generated on the surface of said ink fountain roller; an inking roller; and an intermittent ductor roller for transferring said ink film to said inking roller as a result of periodic contact of said ductor roller with said ink fountain roller and said inking roller; said method comprising:

controlling the rotational speed of the ink fountain roller independently of the printing speed of said printing machine; and varying the rotational contact angle of the intermittent ductor roller on the ink fountain roller according to the printing speed of said printing machine, wherein said undershot inking unit includes intermittent ductor roller drive means, said intermittent ductor roller drive means comprising:

a first cam, said first cam having a first predominant circumferential contour and a first subordinate circumferential contour;

a second cam, said second cam having a second predominant circumferential contour and a second subordinate circumferential contour, said second cam being coaxial with said first cam to thereby form a control cam having a cumulative predominant circumferential contour and a cumulative subordinate circumferential contour;

a cam follower drive roller connected to a pivotal lever arm journalling said intermittent ductor roller for traversing said control cam to thereby cause said intermittent ductor roller to periodically contact said ink fountain roller and said inking roller; and cam orientation means for adjusting the rotational orientation of said first cam with respect to said second cam;

wherein said step of varying the rotational contact angle of the intermittent ductor roller on the ink fountain roller according to the printing speed of said printing machine is accomplished by adjusting the rotational orientation of said first cam with respect to said second cam to thereby vary said cumulative subordinate circumferential contour.

5. A method according to claim 4, wherein said cam orientation means comprises an adjusting gear and a servomotor operably connected to said adjusting gear.

6. A method according to claim 4, wherein said first cam has a first predominant circumferential contour, and an intermediate circumferential contour, said intermediate circumferential contour coinciding with said second predominant circumferential contour of said second cam, and said first cam has a first subordinate circumferential contour coinciding with said second subordinate circumferential contour of said second cam.

* * * * *